US009728133B2

(12) United States Patent
Hu et al.

(10) Patent No.: US 9,728,133 B2
(45) Date of Patent: Aug. 8, 2017

(54) PIXEL UNIT DRIVING CIRCUIT, PIXEL UNIT DRIVING METHOD, PIXEL UNIT AND DISPLAY APPARATUS

(71) Applicants: Boe Technology Group Co., Ltd., Beijing (CN); Chengdu BOE Optoelectronics Technology Co., Ltd., Chengdu, Sichuan (CN)

(72) Inventors: Like Hu, Beijing (CN); Haigang Qing, Beijing (CN); Xiaojing Qi, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan Province (CN)

( * ) Notice: Subject to any disclaimer, the term of this patent is extended or adjusted under 35 U.S.C. 154(b) by 16 days.

(21) Appl. No.: 14/777,719

(22) PCT Filed: Mar. 30, 2015

(86) PCT No.: PCT/CN2015/075368
§ 371 (c)(1),
(2) Date: Sep. 16, 2015

(87) PCT Pub. No.: WO2016/078282
PCT Pub. Date: May 26, 2016

(65) Prior Publication Data

US 2016/0358549 A1 Dec. 8, 2016

(30) Foreign Application Priority Data

Nov. 17, 2014 (CN) ..... 2014 1 0652716

(51) Int. Cl.
*G09G 3/32* (2016.01)
*G09G 3/3258* (2016.01)
(Continued)

(52) U.S. Cl.
CPC ..... *G09G 3/3258* (2013.01); *G09G 3/3233* (2013.01); *G09G 3/3266* (2013.01);
(Continued)

(58) Field of Classification Search
None
See application file for complete search history.

(56) References Cited

U.S. PATENT DOCUMENTS

2005/0052377 A1 3/2005 Hsueh
2014/0078191 A1 3/2014 Yang et al.
2015/0187266 A1* 7/2015 Qian ..... G09G 3/3233 345/77

FOREIGN PATENT DOCUMENTS

CN 1758308 A 4/2006
CN 101996582 A 3/2011
(Continued)

OTHER PUBLICATIONS

First Chinese Office Action (including English translation) dated Mar. 3, 2016, for corresponding Chinese Application No. 201410652716.X.
(Continued)

*Primary Examiner* — Joseph Haley
(74) *Attorney, Agent, or Firm* — Kinney & Lange, P.A.

(57) ABSTRACT

The embodiment of the present disclosure provides a pixel unit driving circuit comprising: a driving unit; a charging unit; a storage unit configured to be charged during the charging stage of the pixel unit driving circuit, and provide a control voltage to the driving unit during a driving stage of the pixel unit driving circuit; a lighting control unit configured to make that a driving current provided from the driving unit to the lighting element during the driving stage of the pixel unit driving circuit is independent on a threshold voltage of the driving unit; and the driving control unit connected to the lighting control unit, the storage unit and
(Continued)

the driving unit and configured to control the supply of the control voltage of the driving unit. According the embodiments of the present disclosure, the influence of the threshold voltage of the driving unit on the operating current is eliminated by providing the lighting control unit and the driving control unit, so as to moderate the drift of the threshold voltage caused by process procedure and a long term operation and to ensure the uniformity of the displayed brightness of the lighting element.

14 Claims, 2 Drawing Sheets

(51) Int. Cl.
*G09G 3/3266* (2016.01)
*G09G 3/3291* (2016.01)
*G09G 3/3233* (2016.01)

(52) U.S. Cl.
CPC ... *G09G 3/3291* (2013.01); *G09G 2300/0809* (2013.01); *G09G 2300/0819* (2013.01); *G09G 2300/0842* (2013.01); *G09G 2300/0861* (2013.01); *G09G 2310/0278* (2013.01); *G09G 2320/0233* (2013.01); *G09G 2330/028* (2013.01)

(56) References Cited

FOREIGN PATENT DOCUMENTS

| | | | |
|---|---|---|---|
| CN | 102930821 | A | 2/2013 |
| CN | 103700342 | A | 4/2014 |
| CN | 103886838 | A | 6/2014 |
| CN | 104134427 | A | 11/2014 |
| CN | 104318899 | A | 1/2015 |

OTHER PUBLICATIONS

The International Search Report mailed Nov. 17, 2014 for International Application No. PCT/CN2015/075368.

* cited by examiner

PIXEL UNIT DRIVING CIRCUIT, PIXEL UNIT DRIVING METHOD, PIXEL UNIT AND DISPLAY APPARATUS

CROSS-REFERENCE TO RELATED APPLICATION(S)

This application claims priority to Chinese Application No. 201410652716.X entitled "PIXEL UNIT DRIVING CIRCUIT, PIXEL UNIT DRIVING METHOD, PIXEL UNIT AND DISPLAY APPARATUS" and filed on Nov. 17, 2014, which is incorporated herein by reference in its entirety.

TECHNICAL FIELD

The present disclosures relates to organic lighting display field, and particularly to pixel unit driving circuit and method, pixel unit and display apparatus for Active Matrix Organic Light Emitting Diode (AMOLED).

BACKGROUND

AMOLED display is one of the hotspots in the current panel display technology. As compared with a liquid crystal display, an OLED presents a number of advantages, such as lower energy consumption, lower production cost, self-luminescence, a wider viewing angle, and a faster response speed. The design for the pixel unit driving circuit is a core of AMOLED display and is important to be researched.

A lighting principle for the AMOLED is that an OLED is driven by current generated by drive transistor (Thin Film Transistor) in a saturation state. Different from TFT-LCD (Thin Film Transistor Liquid Crystal Display) the brightness of which is controlled by a stable voltage, the OLED is driven by current, which needs a stable current to control lighting. When identical grey scale voltages are input, different critical voltages generate different driving current, which leads to inconsistency of the currents.

FIG. 1 shows a conventional OLED pixel unit driving circuit. As shown in FIG. 1, the conventional AMOLED pixel unit driving circuit utilizes a pixel unit driving circuit in a 2T1C configuration. The circuit comprises one drive TFT (T2), one switch TFT (T1) and a storage capacitance Cs. When the scan line selects (i.e. scans) one line to be on and the Vscan is a low level signal, the transistor T1 is turned on and the data signal Vdata is written into the storage capacitance Cs. When the scanning of the line is ended and the Vscan becomes a high level signal, the transistor T1 is turned off and the gate voltage stored on the storage capacitance Cs drives the transistor T2 so that the transistor T2 generates current to drive the OLED to maintain that the OLED continuously irradiate during one frame. The current for the drive TFT (T2) in a saturation state is shown by an equation of $I_{OLED}=K(V_{GS}-Vth)^2$.

Due to reasons such as process and aging of devices, a threshold voltage (Vth) for the drive TFT of the respective pixels drift, which leads to that the current flowing through each of the OLED pixels varies with the change of Vth. Moreover, since there are non homogeneity among the threshold voltages of the drive TFTs for the respective pixels, it directly results in that the current flowing through the OLED of each of the pixels change so that the displayed brightness is uneven and the display effect of the whole image is influenced.

SUMMARY

The embodiment of the present disclosure provides a pixel unit driving circuit, a pixel unit drive method and a display apparatus.

According to one aspect of the embodiment of the present disclosure, there is provided a pixel unit driving circuit for driving a lighting element, the pixel unit driving circuit comprising: a scanning signal line configured to provide scanning signal; a power supply line configured to supply voltage to the pixel unit driving circuit; a data line configured to provide data signals; a driving unit configured to drive the lighting element; a charging unit configured to provide data signal voltage for the driving unit during a charging stage of the pixel unit driving circuit; a storage unit configured to be charged during the charging stage of the pixel unit driving circuit, and provide a control voltage to the driving unit during a driving stage of the pixel unit driving circuit; a lighting control unit configured to make that a driving current provided from the driving unit to the lighting element during the driving stage of the pixel unit driving circuit is independent on the threshold voltage of the driving unit; and the driving control unit connected to the lighting control unit, the storage unit and the driving unit and configured to control the supply of the control voltage of the driving unit.

Preferably, the driving unit comprises a driving transistor, the driving control unit comprises a fourth switching transistor and the storage unit comprises a capacitor; a gate of the driving transistor is connected to a first electrode of the fourth switching transistor, a first electrode of the driving transistor is connected to a first supply voltage provided by the power supply line; and a second electrode of the driving transistor is connected to a first electrode of the capacitor and a second electrode of the fourth switching transistor; a gate of the fourth switching transistor is connected to a first scanning signal provided by the scanning signal line, so that when the fourth switching transistor is turned on, the voltage at the second electrode of the driving transistor is pulled up to be close to the voltage at the gate of the driving transistor to make the driving transistor to rapidly reach the saturation state.

Preferably, the lighting control unit comprises a first switching transistor and a second switching transistor, and the charging unit comprises a fifth switching transistor; a gate of the first switching transistor is connected to a second scanning signal provided by the scanning signal line, a first electrode of the first switching transistor is connected to a second supply voltage supplied by the power supply line, a second electrode of the first switching transistor is connected to a first electrode of the second switching transistor, the gate of the driving transistor and the first electrode of the fourth switching transistor; a gate of the second switching transistor is connected to a third scanning signal provided by the scanning signal line, and a second electrode of the second switching transistor is connected to the second electrode of the capacitor; and a gate of the fifth switching transistor is connected to the second scanning signal, a first electrode of the fifth switching transistor is connected to data signal provided by the data line, and a second electrode of the fifth switching transistor is connected to the second electrode of the capacitor and the second electrode of the second switching transistor.

Preferably, the lighting control unit further comprises a sixth switching transistor; a gate of the sixth switching transistor is connected to a third scanning signal provided by the scanning signal line and the gate of the second switching transistor, a first electrode of the sixth switching transistor is connected to the first electrode of the capacitor, and a second electrode of the sixth switching transistor is connected to the lighting element.

Preferably, the second supply voltage is larger than the threshold voltage of the driving transistor and less than the first supply voltage.

Preferably, the first switching transistor, the second switching transistor, the fourth switching transistor, the fifth switching transistor, the sixth switching transistor and the driving transistor are all N-type thin film transistors.

According another aspect of the present disclosure, there is provided a driving method for the pixel unit driving circuit according to embodiments of the present disclosure. The driving method comprises steps of: in a charging stage, controlling a storage unit to be charged and make the driving unit in a saturation state; in a data writing stage, controlling the threshold voltage of the driving transistor to be written between a gate of the driving transistor and the second electrode so as to continue charging the storage unit until the data signal is written into the storage unit; and in a pixel lighting stage, controlling the storage unit to discharge so as to drive the lighting element to emit light by the driving transistor, wherein during the charging stage, the driving transistor is driven in the saturation state by the driving control unit.

Preferably, during the charging stage, the first scanning signal and the second scanning signal are valid and the third scanning signal is invalid, so that the first switching transistor, the fifth switching transistor, the driving transistor and the fourth switching transistor are turned on, while the second switching transistor and the sixth switching transistor are turned off. Thus, the data signal provided by the data line charges the capacitor so as to make the driving transistor in the saturation state.

Preferably, during the data writing stage, the second scanning signal is kept to be valid, while the first scanning signal and the third scanning signal are invalid, so that the first switching transistor, the fifth switching transistor and the driving transistor are turned on, and the second switching transistor, the fourth switching transistor and the sixth switching transistor are turned off. Thus, the driving transistor reaches a saturation cut-off state and continues charging the capacitor.

Preferably, during the pixel lighting stage, the first scanning signal and the second scanning signal are invalid, while the third scanning signal is valid, so that the second switching transistor and the sixth switching transistor are turned on, and the first switching transistor, the fourth switching transistor and the fifth switching transistor are turned off. Thus, the capacitor is discharged and a saturation current for the driving transistor flows through the lighting element so as to drive the lighting element to emit light. The saturation current is independent of the threshold voltage of the driving transistor.

According to a further aspect of the present disclosure, there is provided a pixel unit including a lighting element and the pixel unit driving circuit according to the embodiments of the present invention, wherein the pixel unit driving circuit is connected to the lighting element so as to drive the lighting element to emit light based on the data signal and the scanning signal.

According to a further aspect of the present disclosure, there is provided a display apparatus including a plurality of pixel units according to the embodiments of the present disclosure.

According the embodiments of the present disclosure, the influence of the threshold voltage of the driving unit on the operating current is eliminated, so as to moderate the drift of the threshold voltage caused by process procedure and a long term operation and to ensure the uniformity of the displayed brightness of the lighting element. Furthermore, the voltage at the source at the driving unit may be rapidly pulled up to the desired voltage so that the charging time for the storage unit is reduced to further improve the uniformity of the displayed images.

DETAILED DESCRIPTION

In order to further clarify objects, technical solutions and advantages of the present invention, the embodiments of the present invention would be further illustrated in detail with reference to the accompany figures in conjunction with the particular embodiments. It is obvious that the illustrated embodiments are only some parts of the embodiments of the present invention and are not all of the embodiments of the present invention. All of the other embodiments made by those skilled in the art without any inventive labors on the basis of the embodiments of the present invention fall within the scope of the present invention.

The switching transistor and the driving transistor utilized by all of the embodiments of the present invention may be thin film transistor, field effect transistor or other devices with the same characters. Preferably, the thin film transistor utilized in the embodiments of the present invention may be oxide semiconductor transistor. Since the source and drain of the utilized switching transistors are symmetrical, their source and drain are exchangeable. In the embodiments of the present invention, in order to distinguish the two electrodes of the transistor except the gate, one of the electrodes is called as the source and the other one of the electrodes are called as the drain.

The embodiment of the present invention provides a pixel unit driving circuit, a pixel unit driving method, a pixel unit and a display apparatus, wherein a short-circuit transistor is provided between the gate and source of the driving transistor T3, so that the source of the driving transistor T3 is rapidly pulled up to about the desired voltage of Vo-Vth so as to shorten charging time for the capacitor Cs.

Figure 1:
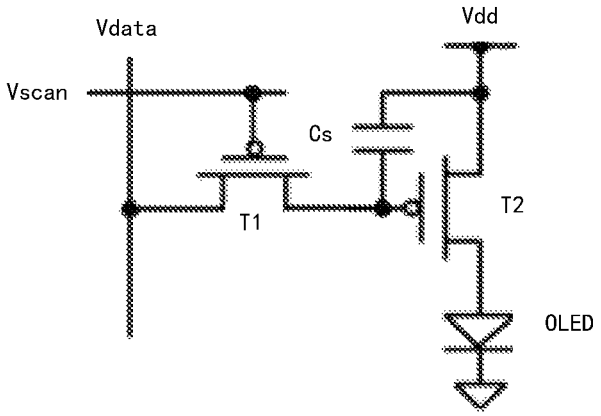
Prior Art Fig. 1
FIG. 1 is a circuit diagram of a conventional 2T1C pixel unit driving circuit.
Figure 2:
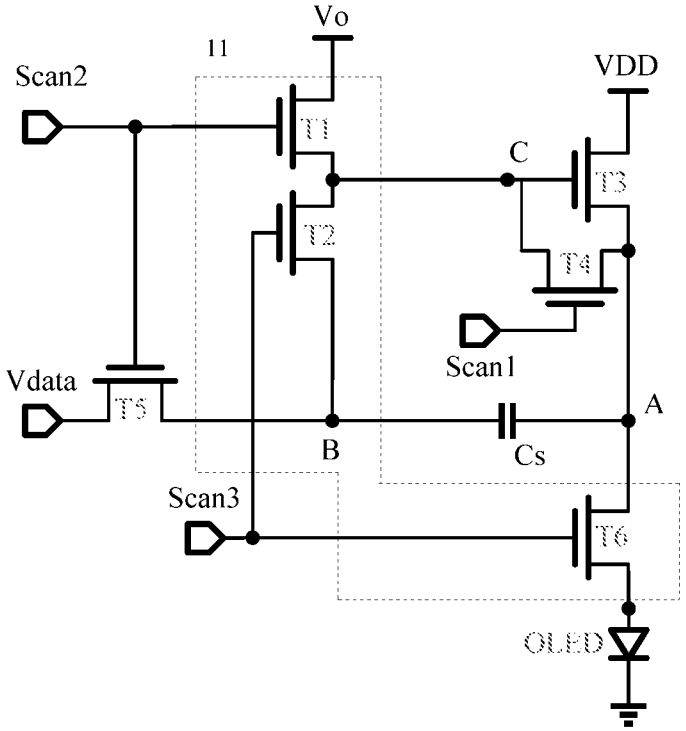
FIG. 2 is a circuit diagram of a pixel unit driving circuit according to one embodiment of the present disclosure.

FIG. 2 shows a circuit diagram of a pixel unit driving circuit according to one embodiment of the present disclosure. The pixel unit driving circuit according to the present embodiment is configured to drive a lighting element such as OLED. As shown in FIG. 2, the pixel unit driving circuit may comprise: scanning signal lines configured to provide scanning signals of Scan1-Scan3; a power supply line configured to supply voltages of Vo and VDD to the pixel unit driving circuit; data line configured to provide data signals; a driving unit configured to drive the lighting element; a charging unit configured to provide data signal voltage for the driving unit during a charging stage of the pixel unit driving circuit; a storage unit configured to be charged during the charging stage of the pixel unit driving circuit, and provide a control voltage to the driving unit during a driving stage of the pixel unit driving circuit; a lighting control unit configured to make that the driving current provided from the driving unit to the lighting element during the driving stage of the pixel unit driving circuit is independent on the threshold voltage of the driving unit; and the driving control unit connected to the lighting control unit, the storage unit and the driving unit and configured to control the supply of the control voltage of the driving unit.

The configuration of the pixel unit driving circuit of the embodiment of the present invention will be illustrated in detail with reference to the accompany figures.

The driving unit may comprise a driving transistor T3. The driving control unit comprises a fourth switching transistor T4. The storage unit comprises a capacitor Cs. A gate of the driving transistor T3 is connected to a first electrode (e.g. drain in case of a N-type transistor) of the fourth switching transistor T4, a first electrode of (e.g. drain in case of a N-type transistor) the driving transistor T3 is connected to a first supply voltage VDD provided by the power supply line; and a second electrode (e.g. source in case of a N-type transistor) of the driving transistor T3 is connected to a first electrode of the capacitor and a second electrode (i.e. source in case of a N-type transistor) of the fourth switching transistor T4, the connecting point of which is labeled as A.

A gate of the fourth switching transistor T4 is connected to a first scanning signal Scan1 provided by the scanning signal line, so that when the fourth switching transistor T4 is turned on, the voltage at the source of the driving transistor T3 is pulled up to be close to the voltage at the gate of the driving transistor T3 to make the driving transistor T3 to rapidly reach the saturation state.

The lighting control unit 11 may comprise a first switching transistor T1, a second switching transistor T2 and a sixth switching transistor T6 and the charging unit comprises a fifth switching transistor T5. A gate of the first switching transistor T1 is connected to a second scanning signal provided by the scanning signal line Scan2, a first electrode (e.g. the drain in case of the N-type transistor) of first switching transistor is connected to a second supply voltage supplied by the power supply line Vo, a second electrode (e.g. source in case of the N-type transistor) of the first switching transistor is connected to a first electrode (e.g. drain in case of the N-type transistor) of the second switching transistor T2, the gate of the driving transistor and the first electrode (e.g. the drain in case of the N-type transistor) of the fourth switching transistor, the connecting point of which is labeled as C. A gate of the second switching transistor T2 is connected to a third scanning signal provided by the scanning signal line Scan3, and a second electrode (e.g. source in case of the N-type transistor) of the second switching transistor is connected to a second electrode of the capacitor Cs. A gate of the fifth switching transistor is connected to the second scanning signal Scan2, a first electrode (e.g. drain in case of the N-type transistor) of the fifth switching transistor is connected to data signal Vdata provided by the data line, and a second electrode (e.g. source in case of the N-type transistor) of the fifth switching transistor is connected to the connecting points of the second electrode of the capacitor Cs and the second electrode of the second switching transistor T2, which is labeled as B. In the lighting control unit 11, a gate of the sixth switching transistor T6 is connected to the third scanning signal Scan3 provided by the scanning signal line and the gate of the second switching transistor T2, a first electrode (e.g. drain in case of the N-type transistor) of the sixth switching transistor is connected to the first electrode of the capacitor at the point C, and a second electrode (e.g. source in case of the N-type transistor) of the sixth switching transistor T6 is connected to the lighting element, and the other terminal of the lighting element OLED is connected to ground. When the sixth switching transistor T6 is turned on, current flows through the OLED to drive the OLED to emit light.

By utilizing the circuit arrangement as mentioned above, the charging and discharging of the capacitor Cs is controlled by the scanning signals Scan1-Scan3 so as to control the driving transistor T3 to operate in the saturation region and to compensate the threshold voltage Vth of the driving transistor T3 by the gate-source voltage of the driving transistor T3.

The fourth switching transistor T4 is connected between the gate and source of the driving transistor T3. That is, the transistor T4 is connected between the gate of the driving transistor T3 at point C and the source of the driving transistor T3 at point A. when the transistor T4 is turned on, the voltage at the source of the driving transistor T3 is rapidly pulled up to be close to the gate voltage, so as to make the transistor T3 rapidly reach a stable saturation state.

The gate of the driving transistor T3 at the point C is connected to the second supply voltage Vo through the first switching transistor T1. The voltage Vo is larger than the threshold voltage Vth of the driving transistor T3 and is less than the first supply voltage VDD, i.e. Vth<Vo<VDD. Meanwhile, the gate at the point C is connected to the point B via the lighting control unit 11 so as to receive input data Vdata.

According to the embodiment of the present invention, the transistors T1-T6 are all N-type thin film transistors.

Alternatively, the first scanning signal Scan1 input to the gate of the fourth switching transistor T4, the second scanning signal Scan 2 input to the gate of the first switching transistor T1 and the gate of the fifth switching transistor T5, and the third scanning signal Scan3 input to the second switching transistor T2 and the gate of the sixth switching transistor T6 do not synchronize with each other. Thus, the transistor T4 and the transistor T6 are controlled independently, and then an accurate control of the displaying time for the pixel is implemented. Meanwhile, the stability of lighting device is ensured so as to prevent the current from passing through the light device during the non-lighting stage, so the usage lifetime of the device is extended.

Figure 3:
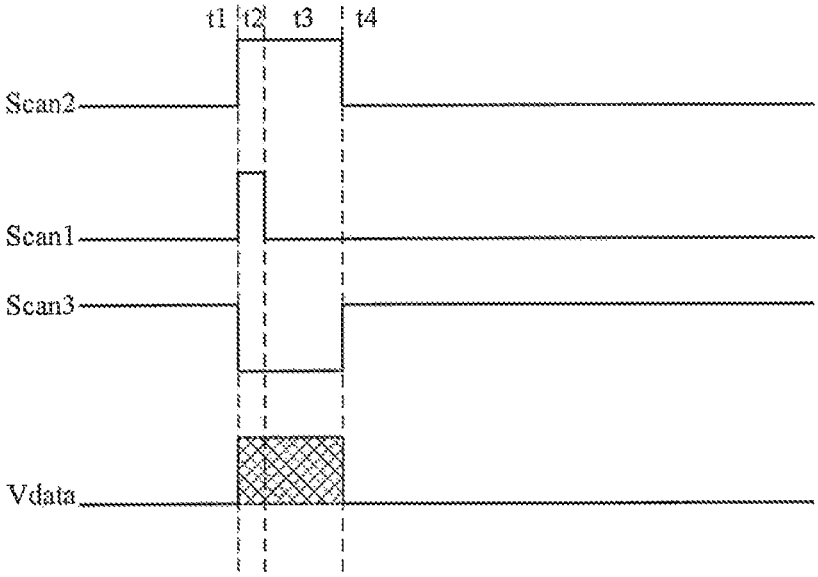
FIG. 3 is a time chart of the respective signals in the pixel unit driving circuit according to the embodiment of the present disclosure.

FIG. 3 shows a time chart of the respective signals in the pixel unit driving circuit according to the embodiment of the present disclosure. The time chart for the operation of the pixel unit driving circuit according to the embodiment of the present disclosure will be illustrated in detail with reference to FIG. 3.

Firstly of all, in a time period of t1, the third scanning signal Scan3 is at a high voltage, the first scanning signal Scan1 and the second scanning signal Scan2 both are at a low voltage. It is a time period for maintaining displaying, in which the displaying brightness is relevant to the data voltage input during the previous stage. In the embodiment of the present invention, the "high voltage" is set to be a valid voltage, and the "low voltage" is set to be an invalid voltage. It should be understood for those skilled in the art that the present invention is not limited to it.

In a time period of t2, Scan1 and Scan2 both are at a high voltage and Scan3 is at a low voltage. Thus, the first switching transistor T1 and the fifth switching transistor T5 is turned on, and the second switching transistor T2 and the sixth switching transistor T6 is turned off. The turning on of the first switching transistor T1 lets the voltage at the point C be Vo, and the turning on of the fifth switching transistor T5 lets the voltage at the point B be Vdata. The voltage at the point C is pulled up to Vo so as to turn on the driving transistor T3; meanwhile, the fourth switching transistor T4 is turned on by Scan1 so as to rapidly pull up the voltage at the point A to Vo. At this moment, for the driving transistor T3, Vgs−Vth=Vo−Vo−Vth=−Vth. When Vth is less than zero (it is true for the oxide semiconductor transistor), Vds−Vgs=VDD−Vo>Vth, the driving transistor T3 is in the saturation state, in which Vds refers to the drain-source voltage of the driving transistor T3. At this moment, the voltage across the capacitor Cs is $V_{BA}$=Vdata−Vo, so that the capacitor is in a charging stage. Such a period is called as the charging stage.

In a period of t3, Scan1 and Scan 3 both are at a low voltage, and Scan2 continues to be at a high voltage. The first switching transistor T1 and the fifth switching transistor T5 are turned on, and the second switching transistor T2 and the sixth switching transistor T6 are turned off. The turning on of the first switching transistor T1 lets the voltage at the point C be Vo so as to keep the driving transistor T3 to be turned on. At this moment, the fourth switching transistor T4 is turned off, and the voltage $V_A$ at the point A continues to be risen up by the function of the driving transistor T3 until Vgs−Vth=Vo−$V_A$−Vth=0, at which the transistor T3 is in the saturation state. At this moment, $V_A$=Vo−Vth=Vo+|Vth|, the capacitor Cs is continued to be charged and the voltage across the capacitor Cs is $V_{BA}$=$V_B$−$V_A$=Vdata−Vo−|Vth|. Such a period is called as the data writing stage.

In a period of t4, Scan3 is at a high voltage, and Scan1 and Scan2 both are at a low voltage. At this moment, the transistors T1, T4 and T5 are turned off, and the transistors T2 and T6 are turned off by Scan3. The capacitor Cs discharges, so that the gate-source voltage of the driving transistor T3 is Vgs=$_{VCA}$=$_{VBA}$=Vdata−Vo−|Vth|, the drain-source voltage is Vds=VDD−(Vo+|Vth|)=VDD−Vo−|Vth|, and Vds−Vgs−Vth=VDD−Vdata+|Vth|>0. Thus, the transistor T3 is stilled operated in the saturation state and its saturation current is $I_{OLED}$=K(Vdata−Vo−|Vth|−Vth)$^2$=K(Vdata−Vo)$^2$, wherein K is a current coefficient of the driving transistor T3 and $$K = C_{ox} \cdot \mu \cdot \frac{W}{L},$$

μ is a field effect mobility, Cox is a unit area capacitance of the gate insulating layer, W is width of the channel, and L is length of the channel.

At this moment, the transistor T6 is turned on and the saturation current $I_{OLED}$ is the current flowing through the OLED, the value of which is independent on the threshold voltage Vth of the transistor T3. Thus, the influence of the drift or nonuniformity of the Vth on the displaying brightness of the OLED is eliminated. Since the transistor T6 is turned on, the OLED emits light (for displaying images) and the lighting at such a data voltage Vdata is maintained until the data voltage for the next frame is written. Thus, such a period is called as lighting stage.

The embodiment of the present invention also provides a driving method for the pixel unit driving circuit as mentioned above. The pixel unit driving method comprising steps of: in a charging stage, controlling a storage unit to be charged and make the driving unit in a saturation state; in a data writing stage, controlling a threshold voltage of the driving transistor to be written between the gate of the driving transistor and the second electrode so as to continue charging the storage unit until the data signal is written into the storage unit; and in a pixel lighting stage, controlling the storage unit to discharge so as to drive the lighting element to emit light by the driving transistor, wherein during the charging stage, the driving transistor is driven in the saturation state by the driving control unit.

The embodiment of the present invention further provides a pixel unit including a lighting element and the pixel unit driving circuit as mentioned above, wherein the pixel unit driving circuit is connected to the lighting element so as to drive the lighting element to emit light based on the data signal and the scanning signal.

The embodiment of the present invention further provides a display apparatus including a plurality of pixel units as mentioned above. The display apparatus may products or components having a displaying function, such as liquid crystal display, electronic paper, mobile phone, tablet computer, television, display, notebook, digital frame, navigator and the like.

The particular embodiments as mentioned above further illustrate the objects, technical solutions and advantageous effects in detail. It should be understood that the above descriptions are only particular embodiments of the present invention and is not intended to limit the present invention. Any of modifications, replacements and improvements based on the spirit and principle of the present invention are included in the scope of the present invention.

We claim:

1. A pixel unit driving circuit for driving a lighting element, the pixel unit driving circuit comprising:

a scanning signal line configured to provide scanning signal;

a power supply line configured to supply voltage to the pixel unit driving circuit;

a data line configured to provide data signals;

a driving unit configured to drive the lighting element, the driving unit comprising a driving transistor;

a charging unit configured to provide data signal voltage for the driving unit during a charging stage of the pixel unit driving circuit;

a storage unit configured to be charged during the charging stage of the pixel unit driving circuit, and provide a control voltage to the driving unit during a driving stage of the pixel unit driving circuit;

a lighting control unit configured such that a driving current provided from the driving unit to the lighting element during the driving stage of the pixel unit driving circuit is independent on a threshold voltage of the driving unit; and a driving control unit connected to the lighting control unit, the storage unit and the driving unit and configured to control the supply of the control voltage of the driving unit, wherein the driving control unit comprises a fourth switching transistor and the storage unit comprises a capacitor; a gate of the driving transistor is connected to a first electrode of the fourth switching transistor; a first electrode of the driving transistor is connected to a first supply voltage provided by the power supply line; a second electrode of the driving transistor is connected to a first electrode of the capacitor and a second electrode of the fourth switching transistor; and a gate of the fourth switching transistor is connected to a first scanning signal provided by the scanning signal line, so that when the fourth switching transistor is turned on, the voltage at the second electrode of the driving transistor is pulled up to be close to the voltage at the gate of the driving transistor to cause the driving transistor to reach the saturation state; and wherein the lighting control unit comprises a first switching transistor and a second switching transistor, and the charging unit comprises a fifth switching transistor; a gate of the first switching transistor is connected to a second scanning signal provided by the scanning signal line; a first electrode of the first switching transistor is connected to a second supply voltage supplied by the power supply line; a second electrode of the first switching transistor is connected to a first electrode of the second switching transistor, the gate of the driving transistor and the first electrode of the fourth switching transistor; a gate of the second switching transistor is connected to a third scanning signal provided by the scanning signal line; a second electrode of the second switching transistor is connected to a second electrode of the capacitor; a gate of the fifth switching transistor is connected to the second scanning signal; a first electrode of the fifth switching transistor is connected to data signal provided by the data line; and a second electrode of the fifth switching transistor is connected to the second electrode of the capacitor and the second electrode of the second switching transistor.

2. The pixel unit driving circuit according to claim 1, wherein the lighting control unit further comprises a sixth switching transistor; a gate of the sixth switching transistor is connected to a third scanning signal provided by the scanning signal line and the gate of the second switching transistor, a first electrode of the sixth switching transistor is connected to the first electrode of the capacitor, and a second electrode of the sixth switching transistor is connected to the lighting element.

3. The pixel unit driving circuit according to claim 1, wherein the second supply voltage is larger than the threshold voltage of the driving transistor and less than the first supply voltage.

4. The pixel unit driving circuit according to claim 2, wherein the first switching transistor, the second switching transistor, the fourth switching transistor, the fifth switching transistor, the sixth switching transistor and the driving transistor are all N-type thin film transistors.

5. A driving method for the pixel unit driving circuit according to claim 1, the pixel unit driving method comprising steps of:

in a charging stage, controlling a storage unit to be charged and place the driving unit in a saturation state;

in a data writing stage, controlling a threshold voltage of the driving transistor to be written between a gate of the driving transistor and the second electrode so as to continue charging the storage unit until the data signal is written into the storage unit; and in a pixel lighting stage, controlling the storage unit to discharge so as to drive the lighting element to emit light by the driving transistor, wherein during the charging stage, the driving transistor is driven in the saturation state by the driving control unit.

6. The pixel unit driving method according to claim 5, wherein during the charging stage, the first scanning signal and the second scanning signal are valid and the third scanning signal is invalid, so that the first switching transistor, the fifth switching transistor, the driving transistor and the fourth switching transistor are turned on, while the second switching transistor and the sixth switching transistor are turned off, thereby the data signal provided by the data line charges the capacitor so as to place the driving transistor in the saturation state.

7. The pixel unit driving method according to claim 6, wherein during the data writing stage, the second scanning signal is kept to be valid, while the first scanning signal and the third scanning signal are invalid, so that the first switching transistor, the fifth switching transistor and the driving transistor are turned on, and the second switching transistor, the fourth switching transistor and the sixth switching transistor are turned off, thereby the driving transistor reaches a saturation cut-off state and continues charging the capacitor.

8. The pixel unit driving method according to claim 7, wherein during the pixel lighting stage, the first scanning signal and the second scanning signal are invalid, while the third scanning signal is valid, so that the second switching transistor and the sixth switching transistor are turned on, and the first switching transistor, the fourth switching transistor and the fifth switching transistor are turned off, thereby the capacitor is discharged and a saturation current for the driving transistor flows through the lighting element so as to drive the lighting element to emit light, the saturation current is independent of the threshold voltage of the driving transistor.

9. A pixel unit including a lighting element and a pixel unit driving circuit, wherein the pixel unit driving circuit is connected to the lighting element so as to drive the lighting element to emit light based on the data signal and the scanning signal, the pixel unit driving circuit comprising:

a scanning signal line configured to provide scanning signal;

a power supply line configured to supply voltage to the pixel unit driving circuit;

a data line configured to provide data signals;

a driving unit configured to drive the lighting element, the driving unit comprising a driving transistor;

a charging unit configured to provide data signal voltage for the driving unit during a charging stage of the pixel unit driving circuit;

a storage unit configured to be charged during the charging stage of the pixel unit driving circuit, and provide a control voltage to the driving unit during a driving stage of the pixel unit driving circuit;

a lighting control unit configured such that the driving current provided from the driving unit to the lighting element during the driving stage of the pixel unit driving circuit is independent on the threshold voltage of the driving unit; and a driving control unit connected to the lighting control unit, the storage unit and the driving unit and configured to control the supply of the control voltage of the driving unit;

wherein the driving control unit comprises a fourth switching transistor and the storage unit comprises a capacitor; a gate of the driving transistor is connected to a first electrode of the fourth switching transistor; a first electrode of the driving transistor is connected to a first supply voltage provided by the power supply line; a second electrode of the driving transistor is connected to a first electrode of the capacitor and a second electrode of the fourth switching transistor; and a gate of the fourth switching transistor is connected to a first scanning signal provided by the scanning signal line, so that when the fourth switching transistor is turned on, the voltage at the second electrode of the driving transistor is pulled up to be close to the voltage at the gate of the driving transistor to cause the driving transistor to reach the saturation state; and wherein the lighting control unit comprises a first switching transistor and a second switching transistor, and the charging unit comprises a fifth switching transistor; a gate of the first switching transistor is connected to a second scanning signal provided by the scanning signal line; a first electrode of the first switching transistor is connected to a second supply voltage supplied by the power supply line; a second electrode of the first switching transistor is connected to a first electrode of the second switching transistor, the gate of the driving transistor and the first electrode of the fourth switching transistor; a gate of the second switching transistor is connected to a third scanning signal provided by the scanning signal line; a second electrode of the second switching transistor is connected to a second electrode of the capacitor; a gate of the fifth switching transistor is connected to the second scanning signal; a first electrode of the fifth switching transistor is connected to a data signal provided by the data line; and a second electrode of the fifth switching transistor is connected to the second electrode of the capacitor and the second electrode of the second switching transistor.

10. A display apparatus including a plurality of pixel units according to claim 9.

11. The pixel unit driving circuit according to claim 1, wherein the first switching transistor, the second switching transistor, the fourth switching transistor, the fifth switching transistor and the driving transistor are all N-type thin film transistors.

12. The pixel unit according to claim 9, wherein the lighting control unit further comprises a sixth switching transistor; a gate of the sixth switching transistor is connected to a third scanning signal provided by the scanning signal line and the gate of the second switching transistor, a first electrode of the sixth switching transistor is connected to the first electrode of the capacitor, and a second electrode of the sixth switching transistor is connected to the lighting element.

13. The pixel unit according to claim 9, wherein the second supply voltage is larger than the threshold voltage of the driving transistor and less than the first supply voltage.

14. The pixel unit according to claim 12, wherein the first switching transistor, the second switching transistor, the fourth switching transistor, the fifth switching transistor, the sixth switching transistor and the driving transistor are all N-type thin film transistors.

* * * * *